US007523771B2

(12) United States Patent
Stavrakis et al.

(10) Patent No.: US 7,523,771 B2
(45) Date of Patent: Apr. 28, 2009

(54) FILLING VALVE APPARATUS FOR A BEVERAGE FILLING MACHINE

(75) Inventors: Demetrios Stavrakis, Booklandville, MD (US); Michael J. Brown, Baltimore, MD (US); Edwin K. Ruble, Parkton, MD (US)

(73) Assignee: ADCOR Industries, Inc., Baltimore, MD (US)

( * ) Notice: Subject to any disclaimer, the term of this patent is extended or adjusted under 35 U.S.C. 154(b) by 80 days.

(21) Appl. No.: 11/538,680

(22) Filed: Oct. 4, 2006

(65) Prior Publication Data

US 2007/0113917 A1 May 24, 2007

Related U.S. Application Data

(60) Provisional application No. 60/723,536, filed on Oct. 4, 2005.

(51) Int. Cl.
*B65B 3/04* (2006.01)

(52) U.S. Cl. ..... 141/367; 141/98; 141/144; 141/387; 141/392

(58) Field of Classification Search ..... 141/144–147, 141/367–368, 57, 98, 387–388, 392; 285/305, 285/308, 317
See application file for complete search history.

(56) References Cited

U.S. PATENT DOCUMENTS 3,176,731 A * 4/1965 Minard ..... 141/295
3,289,712 A * 12/1966 Smith ..... 141/295
3,385,327 A 5/1968 Grainier
3,455,350 A 7/1969 Hinxlage
3,556,316 A 1/1971 Marasso et al.
3,736,966 A 6/1973 Dichiara
3,773,092 A 11/1973 Granier
4,025,049 A * 5/1977 Schmidt ..... 285/317
4,086,943 A 5/1978 Fernandez
4,102,365 A 7/1978 Jordan et al.
4,206,789 A 6/1980 Jordan et al.
4,653,551 A 3/1987 Sindermann
4,893,733 A 1/1990 Thomsen
4,995,534 A 2/1991 Norman
5,425,558 A * 6/1995 Dennany, Jr. ..... 285/308

(Continued)

FOREIGN PATENT DOCUMENTS

FR 2109255 5/1972

(Continued)

OTHER PUBLICATIONS

Partial European Search Report Application No. 06020816 dated Jan. 18, 2007; date received Feb. 15, 2007.

*Primary Examiner*—Timothy L Maust
*Assistant Examiner*—Nicolas A Arnett
(74) *Attorney, Agent, or Firm*—Howard & Howard Attorneys PLLC

(57) ABSTRACT

A filling valve apparatus for a beverage filling machine includes a primary valve portion. A replacement valve portion is coupled to the primary valve portion. A release mechanism is slideably mounted to the primary valve portion. The release mechanism selectively couples the replacement valve portion to the primary valve portion, and the release mechanism is moveable between an engaged position securing the replacement valve portion to the primary valve portion and a disengaged position releasing the replacement valve portion from the primary valve portion.

15 Claims, 7 Drawing Sheets

U.S. PATENT DOCUMENTS 5,964,483 A * 10/1999 Long et al. ..... 285/305
6,076,567 A 6/2000 Naecker et al.
6,109,483 A 8/2000 Wilke et al.
6,170,232 B1 1/2001 VandeGeijn
6,179,016 B1 1/2001 Neacker et al.
6,189,578 B1 2/2001 Clusserath
6,192,946 B1 2/2001 Clusserath
6,213,169 B1 4/2001 Clusserath
6,250,046 B1 6/2001 VandeGeijn
6,634,679 B1 * 10/2003 Stieler ..... 285/308
6,983,958 B2 * 1/2006 Rautureau ..... 285/305
2003/0196721 A1 10/2003 Graffin
2005/0001184 A1 1/2005 Zanga
2005/0057043 A1 * 3/2005 Sazbo et al. ..... 285/305
2005/0178466 A1 8/2005 Tanikawa et al.
2006/0042715 A1 * 3/2006 Stavrakis et al. ..... 141/1

FOREIGN PATENT DOCUMENTS

GB 625730 7/1949

* cited by examiner

FILLING VALVE APPARATUS FOR A BEVERAGE FILLING MACHINE

CROSS REFERENCE TO RELATED APPLICATION

This application claims the benefit of provisional patent application Ser. No. 60/723,536 filed Oct. 4, 2005.

BACKGROUND OF THE INVENTION

1. Field of the Invention

The present invention generally relates to a filling valve apparatus for a beverage filling machine.

2. Description of the Related Art

Filling valve apparatuses for beverage filling machines are known in the art for injecting liquids into beverage containers. However, as the filling valve apparatus is used, certain parts of the filling valve apparatus may begin to wear. For instance, the liquid being injected into the beverage container with the filling valve apparatus may corrode certain parts of the filling valve apparatus. Once corroded, those parts of the filling valve apparatus must be replaced before the beverage filling machine may continue operating. Replacing the corroded parts of the filling valve apparatus can be difficult and time consuming since this often requires removing and replacing the entire filling valve apparatus, which takes considerable time. Also, the beverage filling machine typically incorporates many filling valve apparatuses, and replacing one filling valve apparatus requires stopping the entire beverage filling machine. When filling large quantities of bottles each day, stopping the beverage filling machine to replace the filling valve apparatus reduces production and results in lost profits.

To solve this problem, the filling valve apparatus may include a release mechanism that allows removal of a single part of the filling valve apparatus. Even though the beverage filling machine must still be stopped when the component is removed and replaced, the release mechanism reduces the downtime of the beverage filling machine. One such release mechanism is shown in U.S. Pat. No. 4,893,733 (the '733 patent). The '733 patent discloses the filling valve apparatus having an upper portion and a lower bell adjacent to the upper portion. A valve stem extends through the upper portion and the lower bell. A release mechanism is circumferentially mounted to the lower bell and includes a nut threadably mounted to a shank. The shank is pivotally mounted by a pin whereby loosening the nut permits the shank to be pivoted. Once loosened, the lower bell is released from the upper portion.

Although release mechanisms for filling valve apparatuses such as the one disclosed by the '733 patent may allow removal of the lower bell when corroded by the liquid without having to change the entire filling valve apparatus, there remains an opportunity to improve upon the filling valve apparatuses and release mechanisms of the prior art. For instance, other parts of the filling valve apparatus may need to be replaced in addition to or in lieu of the lower bell. Therefore a filling valve apparatus is needed that either allows removal of other parts than the lower bell or includes multiple release mechanisms so that multiple parts of the filling valve apparatus may be replaced without replacing the entire filling valve apparatus. Additionally, a filling valve apparatus is needed that further reduces downtime when replacing the corroded parts of the filling valve apparatus to improve overall production of the beverage filling machine. Furthermore, a release mechanism is needed that allows the corroded parts of the filling valve apparatus to be removed more easily and quickly, such as with one hand by an operator of the beverage filling machine.

SUMMARY OF THE INVENTION AND ADVANTAGES

The subject invention provides a filling valve apparatus for a beverage filling machine. The filling valve apparatus includes a primary valve portion and a replacement valve portion coupled to the primary valve portion. The filling valve apparatus further includes a release mechanism slideably mounted to the primary valve portion. The release mechanism is selectively coupled to the primary valve portion and moveable between an engaged position securing the replacement valve portion to the primary valve portion and a disengaged position releasing the replacement valve portion from the primary valve portion.

Accordingly, the release mechanism being selectively coupled to the primary valve portion and moveable between the engaged position and the disengaged position allows the replacement valve portion to be quickly and easily removed from the filling valve apparatus and replaced. This helps to reduce downtime when operating the beverage filling machine. In addition, the release mechanism may be placed in various locations on the filling valve apparatus, allowing multiple parts of the filling valve apparatus to act as the primary valve portion and the replacement valve portion. Furthermore, the release mechanism of the subject invention allows the parts of the filling valve apparatus to be more easily removed.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
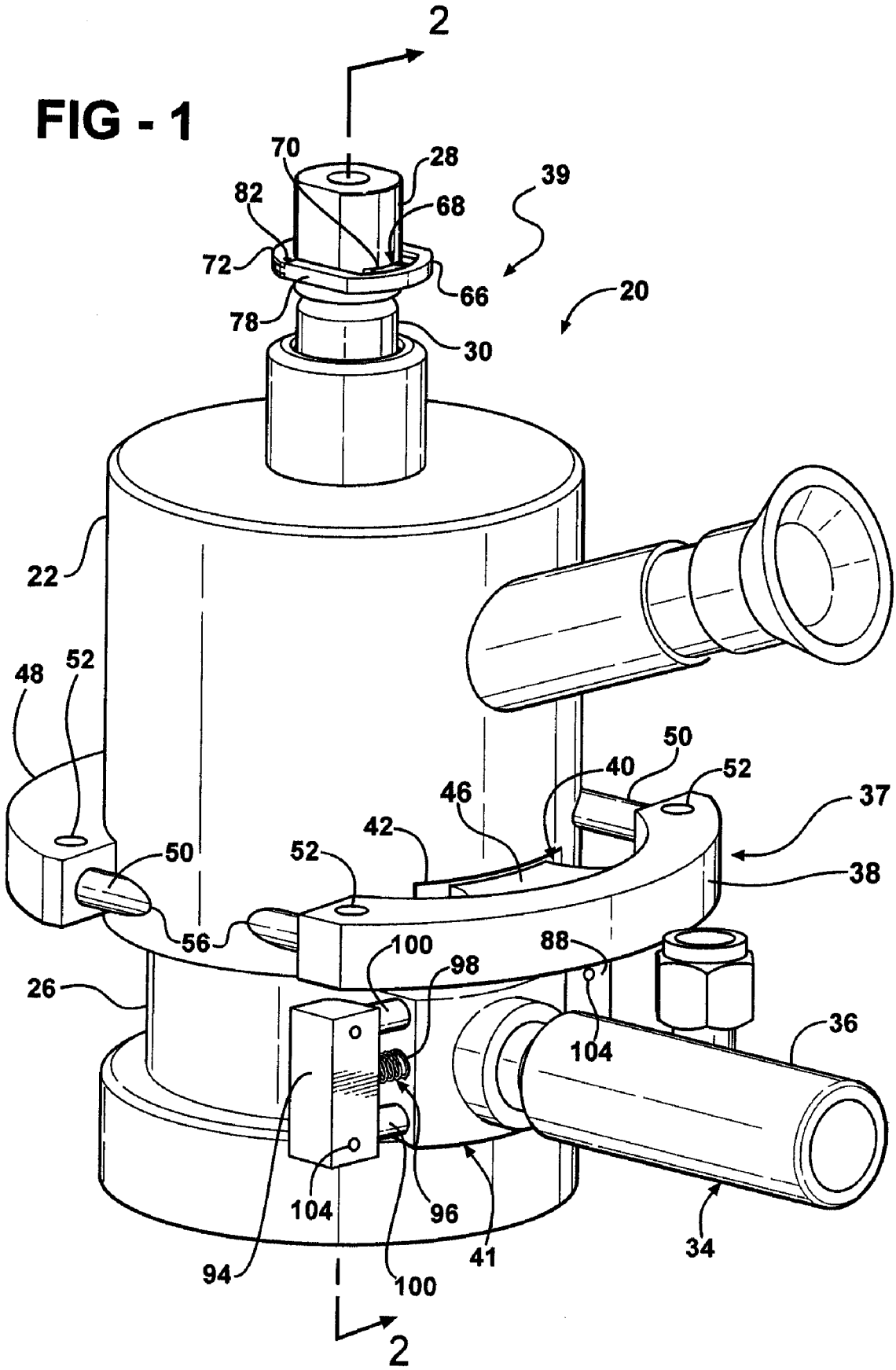
FIG. 1 is a perspective view of a filling valve apparatus used with a beverage filling machine, the filling valve apparatus having a number of release mechanisms.

Referring to the Figures, wherein like numerals indicate corresponding parts throughout the several views, a filling valve apparatus is shown generally at reference numeral 20.

Generally, the filling valve apparatus 20 is used with a beverage filling machine (not shown). Beverage filling machines are known in the art for injecting a fluid into a container (not shown), such as injecting a beverage into a bottle or can. The beverage filling machine often uses many filling valve apparatuses for filling many containers simultaneously. Typically, a conveyor (not shown) is used to bring the container to the filling valve apparatus 20. The filling valve apparatus 20 then descends over the container and fills the container with the beverage. Once filled, the filling valve apparatus 20 lifts up and the conveyor moves the container away from the filling valve apparatus 20.

Figure 2:
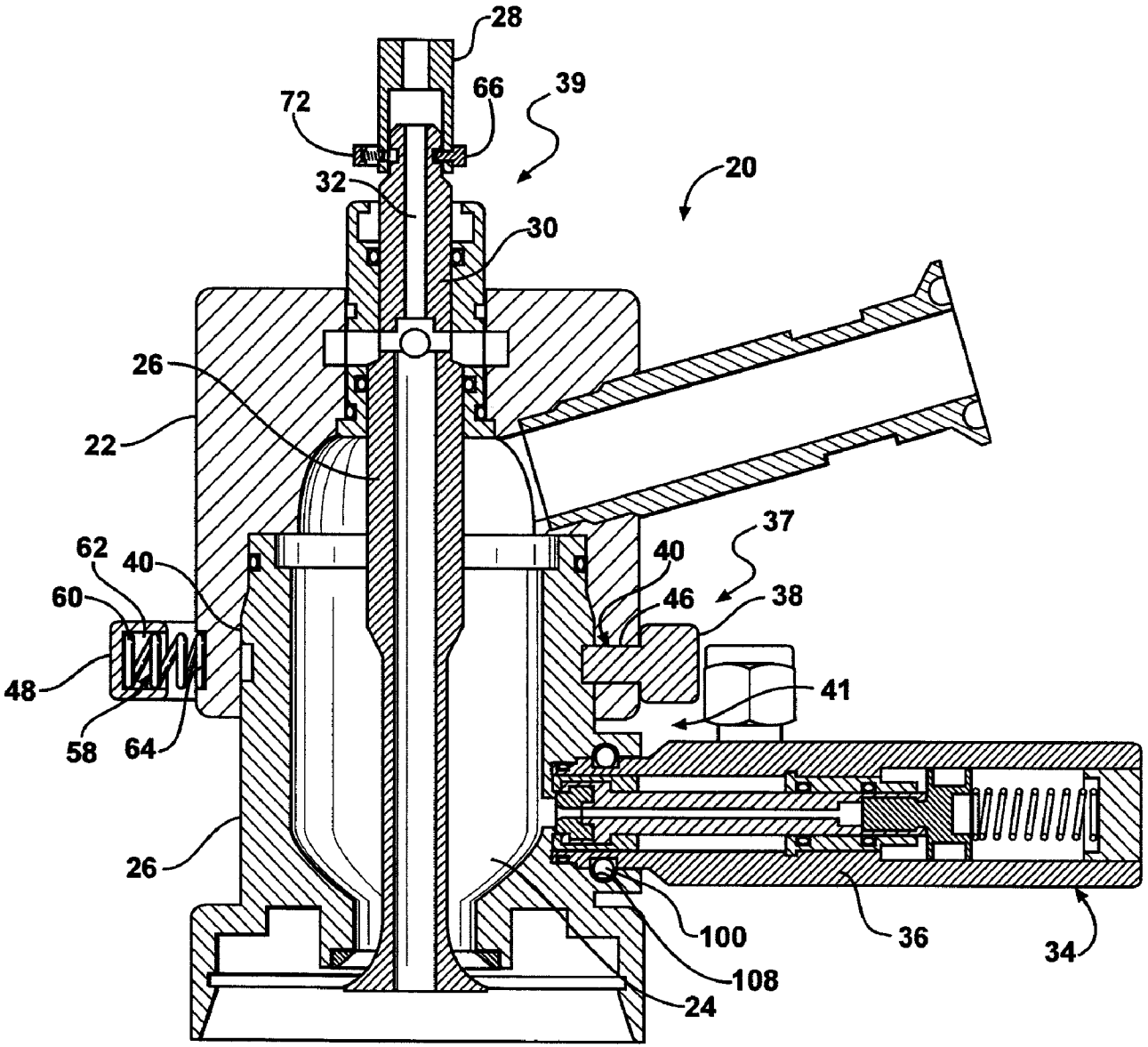
FIG. 2 is a cross-sectional side view of the filling valve apparatus of FIG. 1 taken along the line 2-2.

Referring now to FIGS. 1 and 2, the filling valve apparatus 20 includes an upper portion 22 for mounting to the beverage filling machine. The upper portion 22 defines a fluid passage 24 that allows fluid to enter the filling valve apparatus 20 from the beverage filling machine. A lower bell 26 is coupled to the upper portion 22. Like the upper portion 22, the lower bell 26 further defines the fluid passage 24 to allow the fluid to flow from the upper portion 22 into the container. When operating, the lower bell 26 either fits onto or extends over the container and the fluid flows from the lower bell 26 into the container. An adapter 28 is disposed atop the upper portion 22 for mounting to the beverage filling machine. The adapter 28 regulates air pressure inside the filling valve apparatus 20 such that the fluid only passes from the lower bell 26 and into the container when the pressure in the beverage filling machine is greater than the pressure in the bottle. A stem 30 is coupled to the adapter 28 and extends through the lower bell 26 and the upper portion 22. The stem 30 defines an air passage 32 that allows air to vent from the container as the fluid flows into the container. Generally, the fluid does not flow from the container into the air passage 32. The adapter 28 then changes the pressure in the bottle to stop the flow of the fluid from the beverage filling machine into the container.

The filling valve apparatus 20 includes at least one valve 34 coupled to the lower bell 26. Those skilled in the art realize that various types of valves may connect to the lower bell 26. For instance, a sniff valve (not shown) may be coupled to the lower bell 26 for releasing pressure inside the lower bell 26. Alternatively, a clean in place (CIP) valve 36 may be used for cleaning the fluid passage 24 defined by the lower bell 26 and the upper portion 22. In another alternative, the filling valve apparatus 20 may include both the sniff valve and the CIP valve 34.

As the fluid flows through the fluid passage 24 or through the valve 34, various components of the filling valve apparatus 20 may begin to corrode. Therefore, the filling valve apparatus 20 includes at least one release mechanism to quickly replace corroded portions of the filling valve apparatus 20. Those skilled in the art realize that the filling valve apparatus 20 may include any or all of the release mechanisms described herein. For instance, the filling valve apparatus 20 may include a valve body release mechanism 37 for releasing the lower bell 26 from the upper portion 22, a valve stem release mechanism 39 for releasing the stem 30 from the adapter 28, and/or a valve release mechanism 41 for releasing the valve 34 from the lower bell 26. Each of these release mechanisms operate similarly. Generally, each of the release mechanisms couple a replacement valve portion to a primary valve portion of the filling valve apparatus 20. Specifically, the replacement valve portion is fixed to the primary valve portion with the release mechanism such that the replacement valve portion may be selectively removed from the primary valve portion with the release mechanism. Preferably, the release mechanism is slideably mounted to the primary valve portion, thus selectively coupling the replacement valve portion to the primary valve portion. The release mechanism is moveable between an engaged position securing the replacement valve portion to the primary valve portion and a disengaged position releasing the replacement valve portion from the primary valve portion. Specifically, the release mechanism slides along the primary valve portion from the engaged position to the disengaged position, and back to the engaged position.

The release mechanism described above may be used to release various parts of the filling valve apparatus 20. In other words, different components of the filling valve apparatus 20 may act as the primary valve portion and the replacement valve portion. Furthermore, as discussed in greater detail below, a component may act as the primary valve portion in one embodiment and the replacement valve portion in another embodiment.

Referring now to FIGS. 1-5, in a first embodiment, the filling valve apparatus 20 includes the valve body release mechanism 37 supported by the upper portion 22 and slideably disposed between the engaged position for securing the lower bell 26 to the upper portion 22 and a disengaged position for releasing the lower bell 26 from the upper portion 22. In this embodiment, the upper portion 22 is the primary valve portion and the lower bell 26 is the replacement valve portion. The valve body release mechanism 37 includes a locking handle 38 having a locking element 40 for securing the upper portion to the lower bell when in the engaged position. Generally, the primary valve portion defines an aperture 42 and the replacement valve portion defines a corresponding groove 44 for receiving the locking element 40 in the aperture 42 and the groove 44 and supporting the release mechanism on the primary valve portion. Therefore, in this embodiment, the upper portion defines the aperture 42 and the lower bell defines the groove 44. The locking element 40 is further defined as a tooth 46 extending from the locking handle 38 through the aperture 42 and into the groove 44 for securing the replacement valve portion to the upper portion when in the engaged position.

Figure 3:
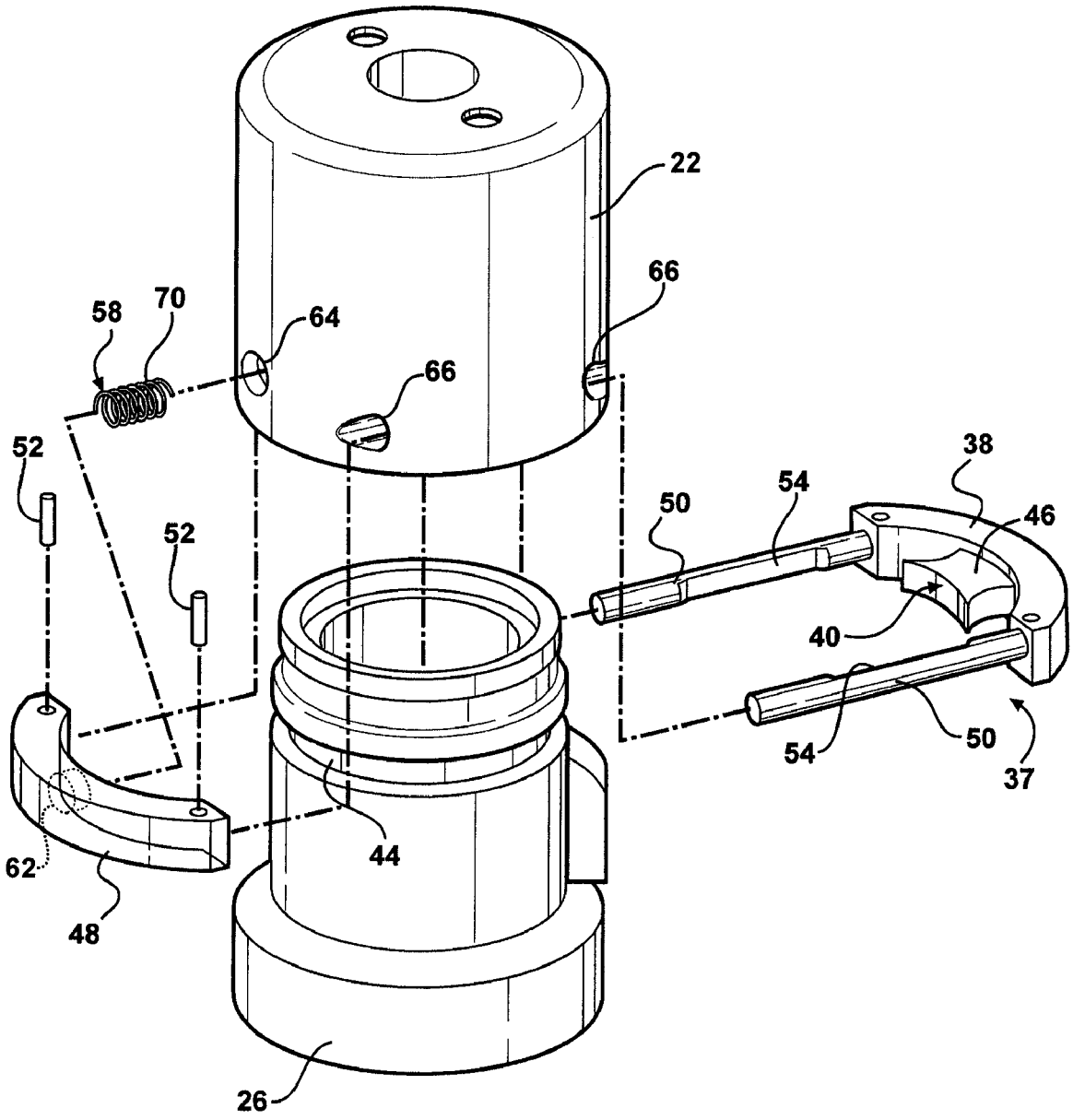
FIG. 3 is an assembly view of a valve body release mechanism used with the filling valve apparatus of FIG. 1.

The release mechanism further includes a release handle 48 coupled to the locking handle 38 for cooperating with the locking handle 38 during the movement between the engaged position and the disengaged position. To connect the locking handle 38 to the release handle 48, the release mechanism further includes a pair of rails 50. The rails 50 extend between the locking handle 38 to the release handle 48 and are held to the locking handle 38 and the release handle 48 with pins 52. The rails 50 may have a round configuration when viewed in cross-section and define at least one notch 54. Also, as shown in FIG. 3, the upper portion may define a pair of openings 56 for receiving the rails 50.

Referring again to FIGS. 1-5, the valve body release mechanism 37 further includes a biasing element 58 mounted to at least one of the locking handle 38 and the release handle 48 for continuously biasing the locking element 40 into the aperture 42 and the corresponding groove 44. For instance, the biasing element 58 is further defined as a spring 60 for biasing the release mechanism in the engaged position. Preferably, the spring 60 is a compression spring attached to the release handle 48 for biasing the locking element 40 in the engaged position. The release handle 48 defines a cavity 62 for housing the biasing element 58 in the cavity 62 between the upper portion and the lower bell. In addition, the upper portion defines a pocket 64 and the biasing element 58 extends from the cavity 62 of the release handle 48 into the pocket 64 for biasing the release mechanism in the engaged position. Here, the biasing element 58 is disposed in the cavity 62 between the release handle 48 and the upper portion.

Alternatively, the spring 60 may be a tension spring attached to the locking handle 38 for biasing the locking element 40 into the aperture 42 and the groove 44. Here, the locking handle 38 defines the cavity 62 for housing the biasing element 58 in the cavity 62 between the locking handle 38 and the upper portion. As in the previous example, the upper portion defines the pocket 64 and the biasing element 58 extends from the cavity 62 of the locking handle 38 into the pocket 64 for biasing the valve body release mechanism in the engaged position. Here, the biasing element 58 is disposed in the cavity 62 between the locking handle 38 and the upper portion 22.

Figure 4:
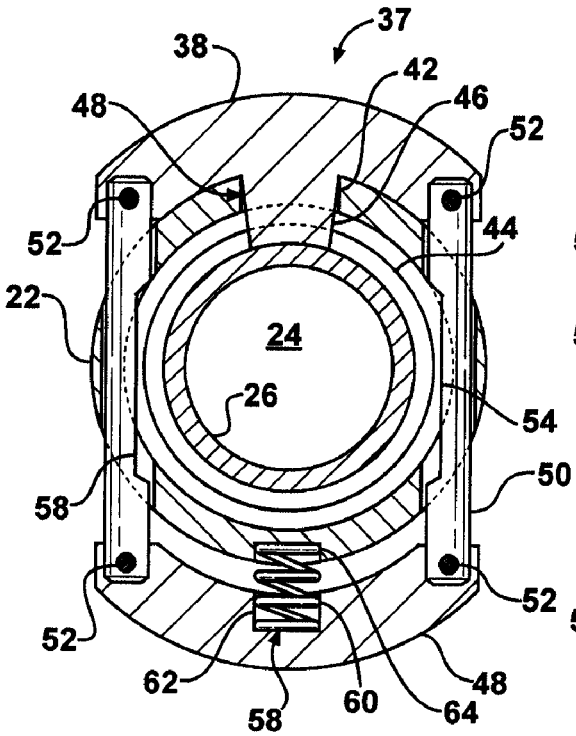
FIG. 4 is a cross-sectional top view of the valve body release mechanism of FIG. 3 in an engaged position.
Figure 5:
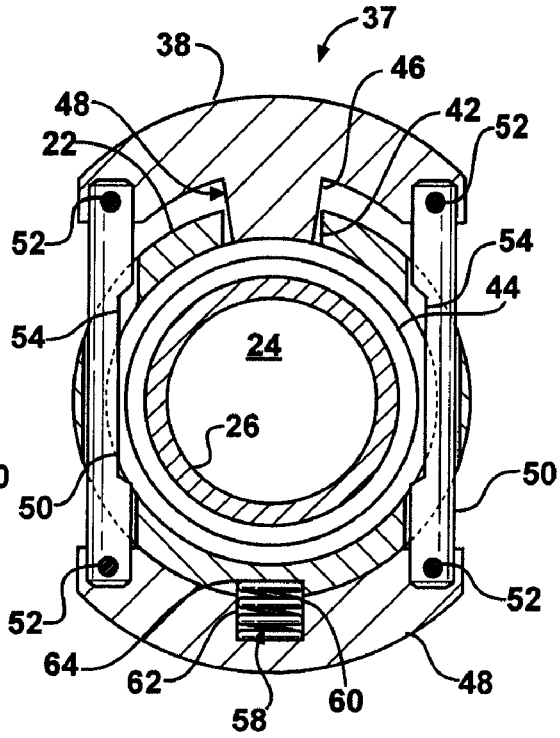
FIG. 5 is a cross-sectional top view of the valve body release mechanism of FIG. 3 in a disengaged position.

In operation, the valve body release mechanism 37 is biased in the engaged position with the biasing element 58. Specifically, as shown in FIG. 4, the spring 60 biases the tooth 46 through the aperture 42 and into engagement with the groove 44. In order to release the lower bell 26 from the upper portion 22, a force is applied to the release handle 48 toward the upper portion 22 to compress the spring 60 placing the valve body release mechanism 37 in the disengaged position. Once compressed far enough, as shown in FIG. 5, the tooth 46 still extends partially into the aperture 42, but is no longer in engagement with the groove 44. Since the tooth 46 is no longer holding the lower bell 26 to the upper portion 22, the lower bell 26 is released relative to the upper portion 22.

Referring now to FIGS. 1, 2, and 6-8, in a second embodiment, the valve stem release mechanism 39 is supported by the adapter 28 and slideably disposed between a locked position for securing the stem 30 to the adapter 28 and an unlocked position for releasing the stem 30 from the adapter 28. In this embodiment, the adapter 28 is the primary valve portion and the stem 30 is the replacement valve portion. The valve body release mechanism 37 includes a locking handle 66 having a locking element 68, such as a tooth 70 as previously described, and a release handle 72 having a biasing element 74, such as a spring 76 as previously described. In addition, the adapter 28 defines a pocket 77 and the biasing element 74 extends from a cavity 79 defined by the release handle 72 into the pocket 77 for biasing the valve stem release mechanism 39 in the engaged position. Here, the biasing element 74 is disposed in the cavity 79 between the release handle 72 and the adapter 28.

The valve stem release mechanism 39 further includes a pair of rails 78 and the adapter 28 defines a slot 80. The rails 78 include longitudinal tabs 81 slideably disposed in the slot 80 defined by the adapter 28. Here, the tabs 81 of the rails 78 rest in the slot 80 defined by the adapter 28 regardless of whether the release mechanism 38 is in the engaged or disengaged position. In this embodiment, the rails 78 are integrally formed with the locking handle 66 and held to the release handle 72 with pins 82. Here, the adapter 28 defines an aperture 84 and the stem 30 defines a corresponding groove 86 as described in the previous embodiment.

Figure 7:
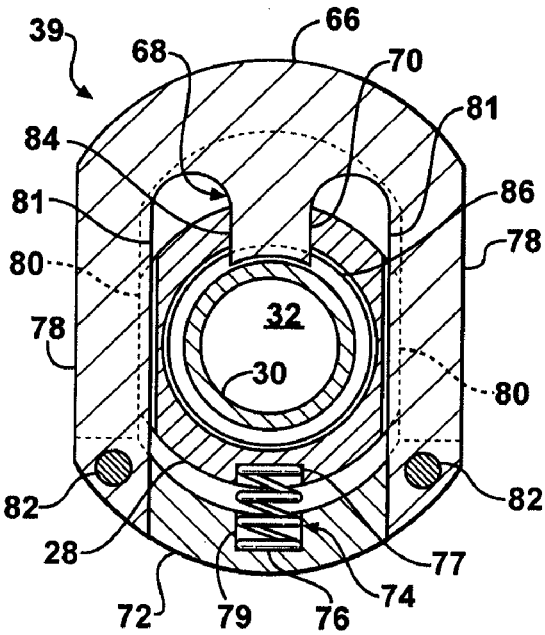
FIG. 7 is a cross-sectional top view of the valve stem release mechanism of FIG. 6 in a locked position.
Figure 8:
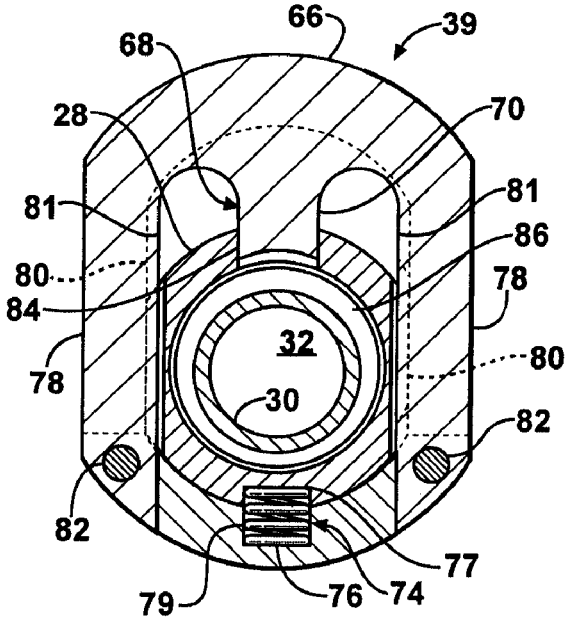
FIG. 8 is a cross-sectional top view of the valve stem release mechanism of FIG. 6 in an unlocked position.
Figure 6:
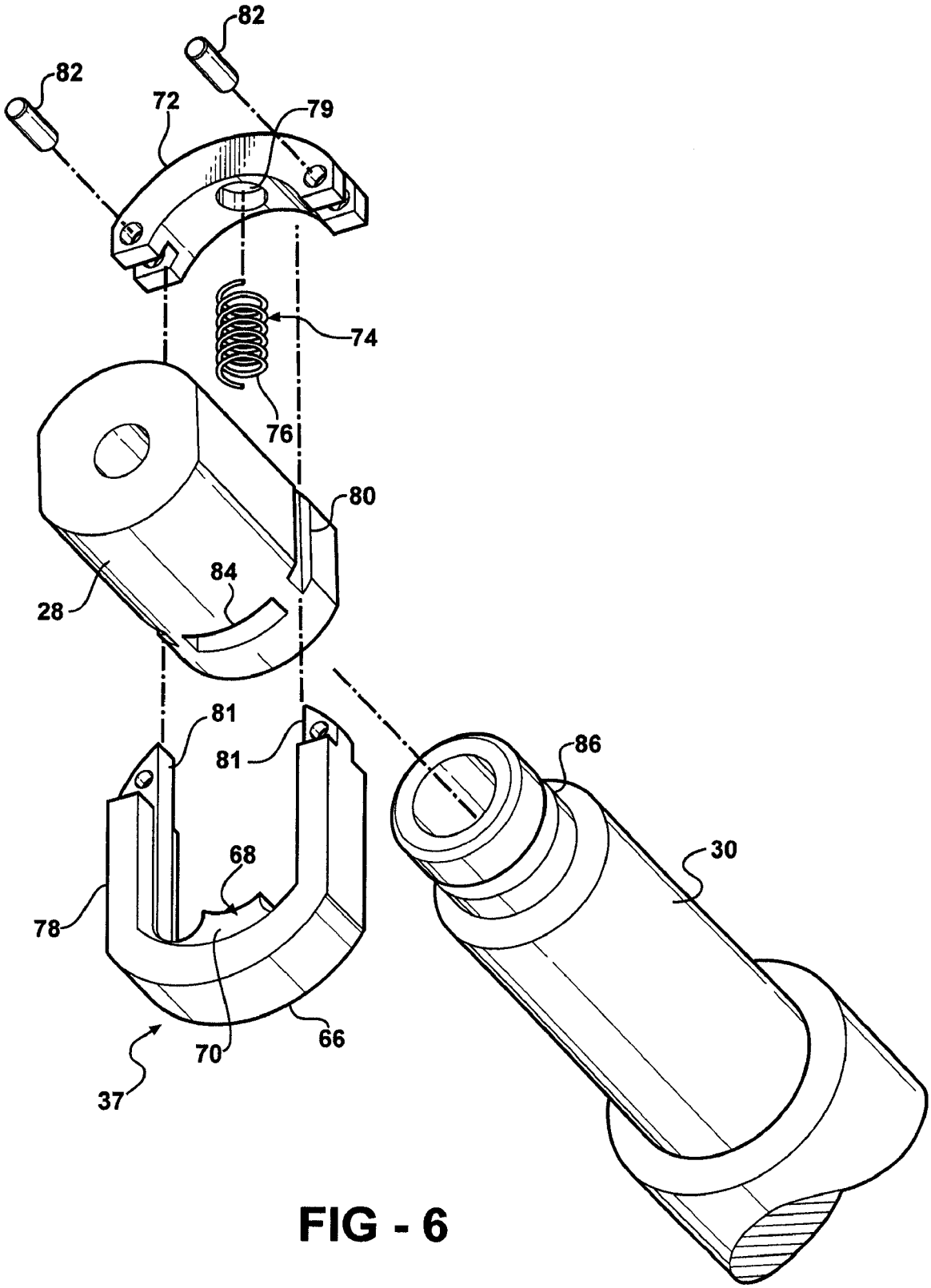
FIG. 6 is an assembly view of a valve stem release mechanism used with the filling valve apparatus of FIG. 1.

In operation, the valve stem release mechanism 39 is biased in the locked position with the spring 76. Specifically, as shown in FIG. 7, the spring 76 biases the tooth 70 through the aperture 84 and into engagement with the groove 86. In order to release the stem 30 from the adapter 28, a force is applied to the release handle 72 toward the adapter 28 to compress the spring 76, placing the valve stem release mechanism 39 in the locked position. Once compressed far enough, as shown in FIG. 8, the tooth 70 is no longer in engagement with the groove 86. When not engaged with the groovel52, the tooth 70 no longer holds the stem 30 to the adapter 28. Since the tooth 70 is no longer holding the stem 30 to the adapter 28, the stem 30 is released relative to the adapter 28 when the valve stem release mechanism 39 is in the unlocked position.

In a third embodiment, as shown in FIGS. 1, 2, and 9-11, the valve release mechanism 41 is supported by the lower bell 26 and slideably disposed between a secured position for securing the valve to the lower bell 26 and an unsecured position for releasing the valve from the lower bell 26. In this embodiment, the lower bell 26 is as the primary valve portion and the valve is as the replacement valve portion. Although the lower bell 26 was the replacement valve portion in the first embodiment, here, the lower bell 26 is the primary valve portion because it supports the valve release mechanism 41. Therefore, the lower bell 26 is the replacement portion in the first embodiment and the primary valve portion in this third embodiment.

Figure 9:
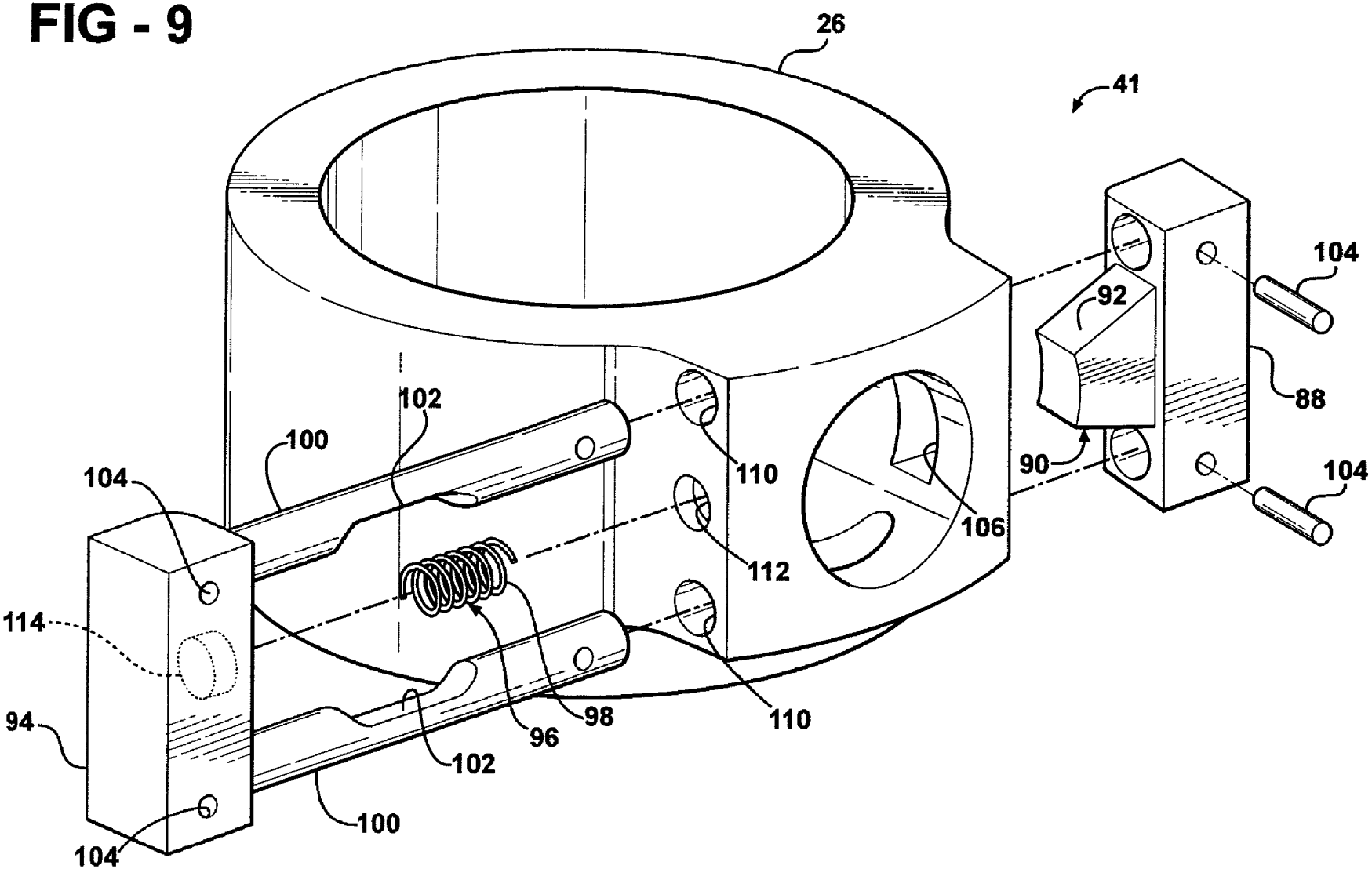
FIG. 9 is an assembly view of a valve release mechanism used with the filling valve apparatus of FIG. 1.
Figure 10:
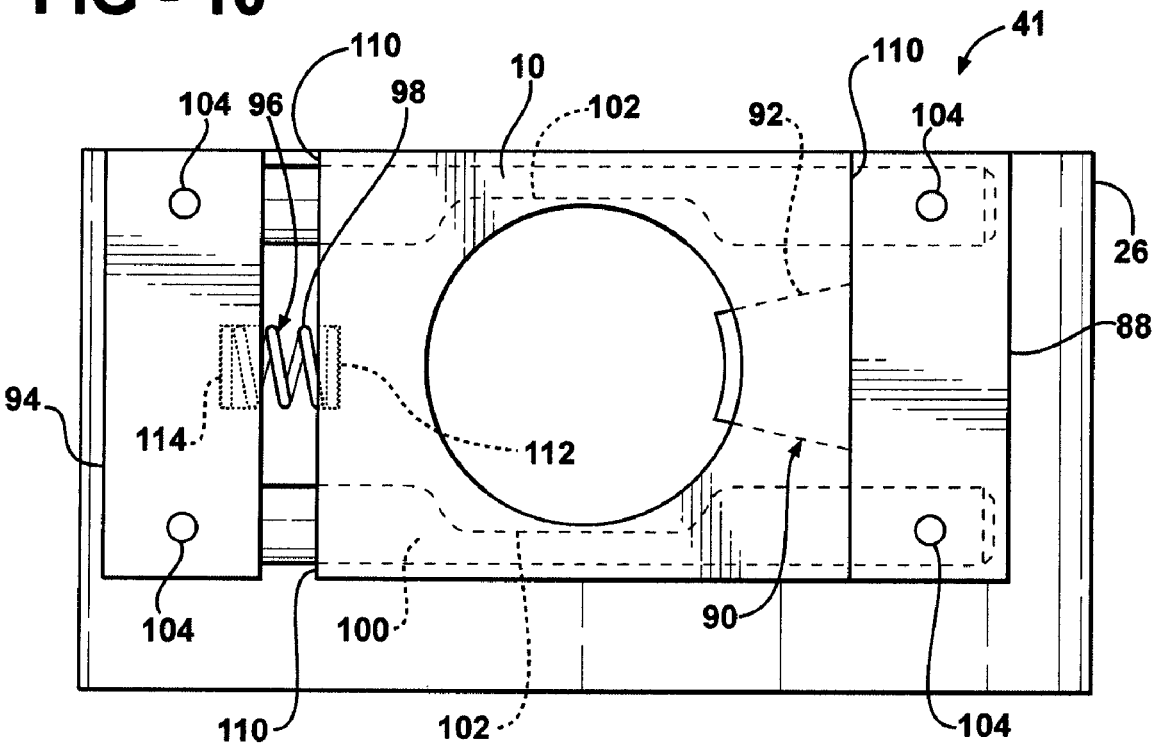
FIG. 10 is a side view of the valve release mechanism of FIG. 9 in a secured position.
Figure 11:
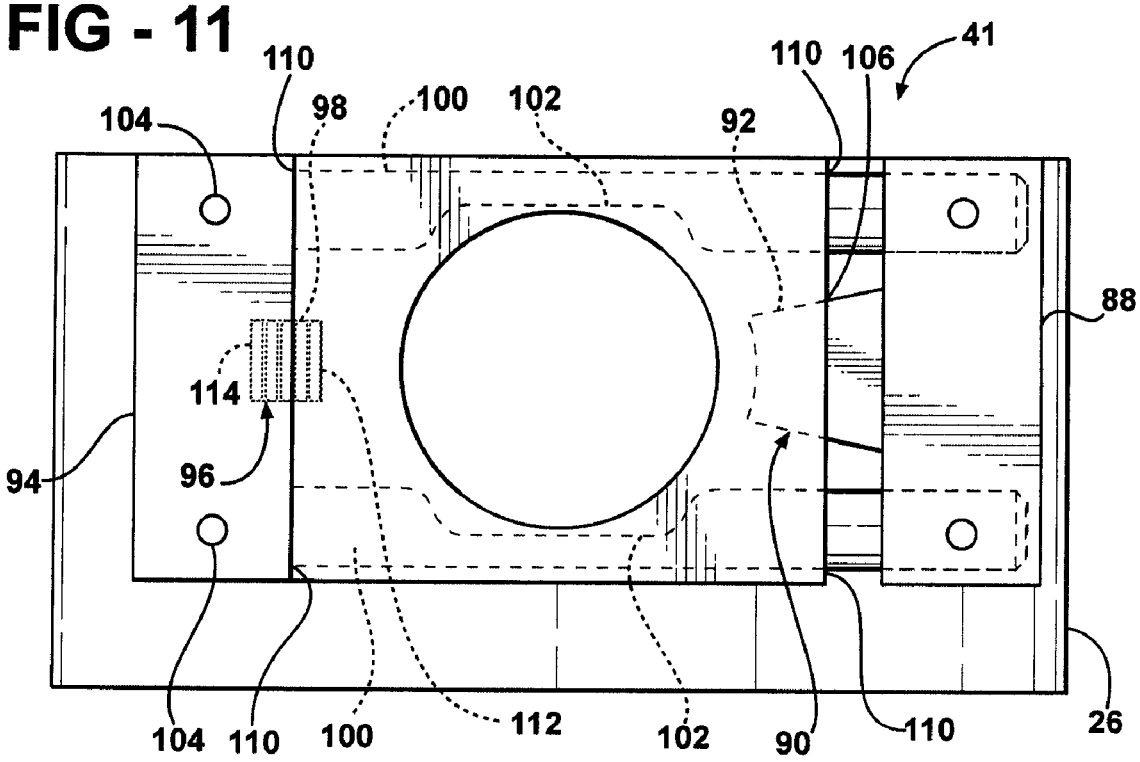
FIG. 11 is a side view of the valve release mechanism of FIG. 9 in an unsecured position.

Referring to FIGS. 9-11, the valve release mechanism 41 includes a locking handle 88 having a locking element 90. In this embodiment, the locking element 90 is further defined as a tooth 92. As in the previous embodiments, the valve release mechanism 41 includes a release handle 94 that includes a biasing element 96, which is a spring 98 as described above. The valve release mechanism 41 further includes a pair of rails 100 each having the notch 102 described above. The rails 100 are integrally formed with the release handle 94 and held to the locking handle 88 with pins 104. Here, the lower bell 26 defines an aperture 106 and the valve defines a corresponding groove 108 for receiving the tooth 92. Also, the lower bell 26 defines openings 110 for receiving the rails 100. In addition, the lower bell 26 defines a pocket 112 and the biasing element 96 extends from a cavity 114 defined by the release handle 94 into the pocket 112 for biasing the valve release mechanism 41 in the engaged position. Here, the biasing element 96 is disposed in the cavity 114 between the release handle 94 and the lower bell 26.

In operation, the valve release mechanism 41 is biased in the engaged position with the biasing element 96. Specifically, as shown in FIG. 10, the spring 98 biases the tooth 92 through the aperture 106 and into engagement with the groove 108. In order to release the valve from the lower bell 26, a force is applied to the release handle 94 against the spring 98 to compress the spring 98, placing the valve body release mechanism 37 in the unsecured position. Once compressed far enough, as shown in FIG. 11, the tooth 92 is no longer in engagement with the groove 108. Since the tooth 92 is no longer holding the valve 34 to the lower bell 26, the valve 34 is released relative to the lower bell 26.

Accordingly, the subject invention provides a filling valve apparatus 20 having at least one release mechanism being selectively coupled to the primary valve portion and moveable between the engaged position and the disengaged position to allow the replacement valve portion to be quickly and easily removed from the filling valve apparatus 20 and replaced regardless of which parts of the filling valve apparatus 20 act as the primary valve portion and the replacement valve portion 42. This helps to reduce downtime when operating the beverage filling machine. In addition, the release mechanism may be placed in various locations on the filling valve apparatus 20, allowing multiple parts of the filling valve apparatus 20 to act as the primary valve portion and the replacement valve portion. Furthermore, the release mechanism of the subject invention allows the parts of the filling valve apparatus 20 to be more easily removed.

The invention has been described in an illustrative manner, and it is to be understood that the terminology which has been used is intended to be in the nature of words of description rather than of limitation. As is now apparent to those skilled in the art, many modifications and variations of the present invention are possible in light of the above teachings. It is, therefore, to be understood that within the scope of the appended claims the invention may be practiced otherwise than as specifically described

What is claimed is:

1. A filling valve apparatus for a beverage filling machine, said filling valve apparatus comprising:

a primary valve portion defining an aperture and a pair of openings spaced from said aperture;

a replacement valve portion coupled to said primary valve portion and defining a groove; and a release mechanism slideably mounted to said primary valve portion and selectively coupling said replacement valve portion to said primary valve portion with said release mechanism being moveable between an engaged position securing said replacement valve portion to said primary valve portion and a disengaged position releasing said replacement valve portion from said primary valve portion;

said release mechanism including a locking handle having a locking element extending through said aperture and into said groove for securing said replacement valve portion to said primary valve portion when in said engaged position;

said release mechanism further including a release handle connected to said locking handle for cooperating with said locking handle during said movement between said engaged position and said disengaged position; and said release mechanism further including a pair of rails connecting said locking handle and said release handle with one of said rails disposed in each of said openings of said primary valve portion for supporting said release mechanism on said primary valve portion;

wherein each of said openings of said primary valve portion are further defined as a slot and said rails include longitudinal tabs slideably disposed in said slot.

2. A filling valve apparatus as set forth in claim 1 wherein said locking element is further defined as a tooth cantilevered from said locking handle for extending through said aperture and into said groove.

3. A filling valve apparatus as set forth in claim 1 wherein each of said pair of rails define at least one notch.

4. A filling valve apparatus as set forth in claim 1 wherein said rails have a round configuration when viewed in cross-section.

5. A filling valve apparatus as set forth in claim 1 wherein said release mechanism further includes a biasing element mounted to at least one of said locking handle and said release handle for continuously biasing said locking element into said aperture and said groove.

6. A filling valve apparatus as set forth in claim 5 wherein said biasing element is further defined as a spring for biasing said release mechanism in the engaged position.

7. A filling valve apparatus as set forth in claim 5 wherein said primary valve portion defines a pocket and at least one of said release handle and said locking handle define a cavity for housing said biasing element in said pocket and said cavity between said primary valve portion and at least one of said release handle and said locking handle.

8. A filling valve apparatus comprising: a primary valve portion; a replacement valve portion couple to said primary valve portion and defining a groove;

a locking handle having a locking element for selectively coupling the replacement valve portion to the primary valve portion with said locking element being moveable between an engaged position securing the replacement valve portion to the primary valve portion and a disengaged position releasing the replacement valve portion from the primary valve portion;

a release handle connected to said locking handle for cooperating with said locking handle during said movement between the engaged position and the disengaged position;

a biasing element disposed on at least one of the locking handle and the release handle for continuously biasing said locking element into the engaged position; and a pair of rails connecting said locking handle and said release handle with each of said rails defining at least one notch with said notches facing inwardly toward each other and continuously spaced from said groove during said movement for providing adequate clearance for releasing the replacement valve portion from the primary valve portion.

9. A filling valve apparatus as set forth in claim 8 wherein said rails have a round configuration when viewed in cross-section.

10. A filling valve apparatus as set forth in claim 8 wherein said locking element is further defined as a tooth cantilevered from said locking handle for securing the replacement valve portion to the primary valve portion.

11. A filling valve apparatus as set forth in claim 8 wherein said biasing element is further defined as a spring for biasing said locking element into engagement with the primary valve portion.

12. A filling valve apparatus as set forth in claim 8 wherein at least one of said locking handle and said release handle define a cavity for housing said biasing element in said cavity.

13. A filling valve apparatus for a beverage filling machine, said filling valve apparatus comprising:

an upper portion for mounting to the beverage filling machine;

a lower bell coupled to said upper portion;

an adapter for mounting to the beverage filling machine with said adapter being spaced from said upper portion and including an inner bore;

a stem coupled to said adapter and at least partially extending through said lower bell and said upper portion with said stem including a passageway in fluid communication with said bore when coupled to said adapter;

a valve body release mechanism supported by and slideably mounted to said upper portion with said valve body release mechanism slideably moveable between an engaged position securing said lower bell to said upper portion and a disengaged position releasing said lower bell from said upper portion; and a valve stem release mechanism supported by and slideably mounted to said adapter with said valve stem release mechanism slideably moveable between a locked position securing said stem to said adapter and an unlocked position releasing said stem from said adapter.

14. A filling valve apparatus as set forth in claim 13 further including a valve coupled to said lower bell.

15. A filling valve apparatus as set forth in claim 14 further including a valve release mechanism supported by and slideably mounted to said lower bell with said valve release mechanism slideably moveable between a secured position securing said valve to said lower bell and an unsecured position releasing said valve from said lower bell.

* * * * *

UNITED STATES PATENT AND TRADEMARK OFFICE

CERTIFICATE OF CORRECTION

PATENT NO. : 7,523,771 B2
APPLICATION NO. : 11/538680
DATED : April 28, 2009
INVENTOR(S) : Demetrios Stavrakis et al.

It is certified that error appears in the above-identified patent and that said Letters Patent is hereby corrected as shown below:

Column 7, Line 60

Please delete “couple” and insert --coupled--.

Signed and Sealed this

Twenty-eighth Day of July, 2009

JOHN DOLL
*Acting Director of the United States Patent and Trademark Office*